US009195171B2

(12) United States Patent
Morita

(10) Patent No.: US 9,195,171 B2
(45) Date of Patent: Nov. 24, 2015

(54) TONER CASE AND IMAGE FORMING APPARATUS INCLUDING THE TONER CASE

(71) Applicant: KYOCERA Document Solutions Inc., Osaka (JP)

(72) Inventor: Takashi Morita, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/279,620

(22) Filed: May 16, 2014

(65) Prior Publication Data

US 2014/0348544 A1 Nov. 27, 2014

(30) Foreign Application Priority Data

May 21, 2013 (JP) ..... 2013-107228

(51) Int. Cl.
*G03G 15/08* (2006.01)
*G03G 21/16* (2006.01)

(52) U.S. Cl.
CPC ..... *G03G 15/0875* (2013.01); *G03G 21/1647* (2013.01); *G03G 21/1676* (2013.01); *G03G 15/0863* (2013.01)

(58) Field of Classification Search
CPC ..... G03G 21/1821; G03G 21/16; G03G 21/1842; G03G 21/1674; G03G 21/1676
See application file for complete search history.

(56) References Cited

U.S. PATENT DOCUMENTS

| | | | | |
|---|---|---|---|---|
| 6,829,462 | B2 * | 12/2004 | Nagashiro | 399/258 |
| 8,238,765 | B2 * | 8/2012 | Naoi et al. | 399/12 |
| 2006/0182469 | A1 | 8/2006 | Koyama et al. | |
| 2008/0118254 | A1 * | 5/2008 | Kawai | 399/12 |

FOREIGN PATENT DOCUMENTS

| | | |
|---|---|---|
| JP | 2001-272851 | 10/2001 |
| JP | 2009-003326 | 1/2009 |

* cited by examiner

*Primary Examiner* — Clayton E Laballe
*Assistant Examiner* — Ruifeng Pu
(74) *Attorney, Agent, or Firm* — Wenderoth, Lind & Ponack, L.L.P.

(57) ABSTRACT

A toner case is directly or indirectly connected to a housing 31 that contains toner at a first connection portion 43 and a second connection portion 44, and includes: a bracket portion 33 that is formed so as to link the first connection portion 43 and the second connection portion 44; protrusions 51 and 52 that are formed on the bracket portion 33, allow for attachment of the housing 31 to an apparatus body of a specific model, and do not allow for attachment of the housing 31 to the apparatus body of other models except for the specific model; and a functional member 55 that is installed on the bracket portion 33 and that fulfills a predetermined function.

3 Claims, 11 Drawing Sheets

TONER CASE AND IMAGE FORMING APPARATUS INCLUDING THE TONER CASE

CROSS-REFERENCE TO RELATED APPLICATION

Japanese Patent Application No. 2013-107228

BACKGROUND

A technology of the present disclosure relates to a toner case and an image forming apparatus including the same.

In an image forming apparatus such as a copier and a laser printer, for example, different types of dry toner are used depending on specifications of image quality, a destination, a color of an image, or the like. Therefore, typically, adaptable toner is specified for the image forming apparatus.

When a user uses unspecified toner, a mechanism failure, an image failure, and the like of the image forming apparatus may occur. Therefore, it is required to eliminate interchangeability of a toner case that contains toner for a plurality of models of the image forming apparatus.

It is then proposed to form a protrusion to identify a model on a toner case, the protrusion having a form and a location that are different depending on a model of the image forming apparatus, and to form a recess that is engaged with the protrusion on an apparatus body to which the toner case is attached.

However, since the protrusion is generally formed of a resin material along with the body of the toner case, the protrusion can be easily cut off by a box cutter or the like. This results in a problem that it becomes possible-it should be otherwise impossible-to correctly attach a toner case obtained by cutting off the protrusion, to an image forming apparatus.

On the other hand, it is proposed to form a protrusion to be hollow and insert a cored bar in a hollow part of the protrusion. This configuration can make it difficult to cut off the protrusion by a box cutter or the like since the cored bar is installed inside the protrusion.

SUMMARY

A toner case according to one aspect of the present disclosure is a toner case that is attached to an apparatus body of an image forming apparatus. This toner case includes a housing, a bracket portion, a protrusion, and a functional member. Toner is contained in the housing. The bracket portion is connected directly or indirectly to the housing at a first connection portion and a second connection portion, and formed so as to link the first connection portion and the second connection portion. The protrusion is formed on the bracket portion, and configured to allow for attachment of the housing to the apparatus body of a specific model and not to allow for attachment of the housing to the apparatus body of other models except for the specific model. The functional member is installed on the bracket portion and configured to fulfill a predetermined function.

DETAILED DESCRIPTION

Hereinafter, the present embodiment will be described in detail with reference to the drawings. It is noted that the technology of the present disclosure is not limited to the following embodiments.

<<First Embodiment>>

<Laser Printer>

Figure 1:
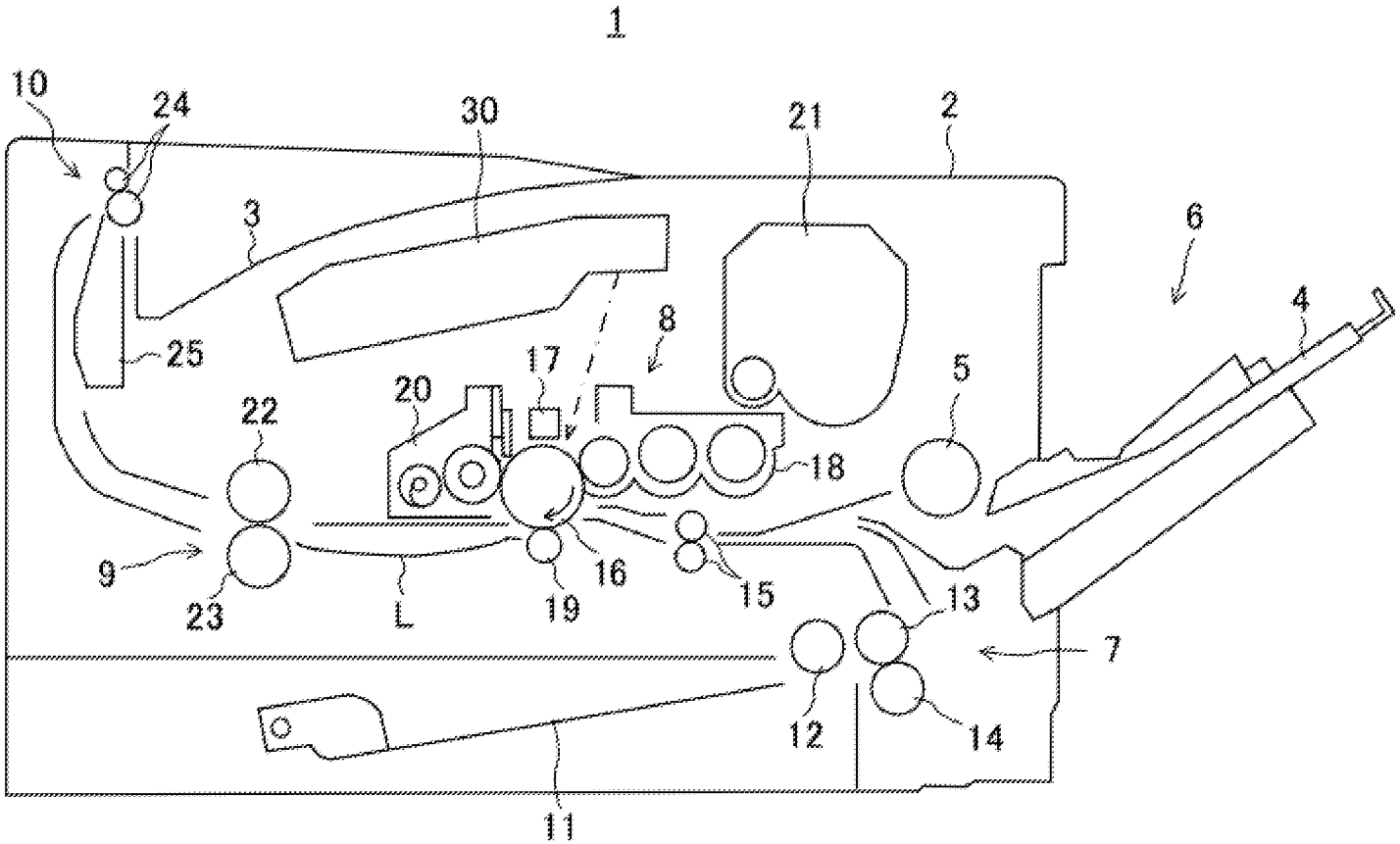
FIG. 1 is a cross-sectional view showing a schematic configuration of a laser printer as an image forming apparatus in the present embodiment.

FIG. 1 is a cross-sectional view showing a schematic configuration of a laser printer 1 as an image forming apparatus in the present embodiment.

As shown in FIG. 1, the laser printer 1 includes an apparatus body 2 and a toner container 21 as a toner case that is detachably attached to the apparatus body 2.

The apparatus body 2 has a manual paper feeding unit 6, a cassette paper feeding unit 7, an image forming unit 8, a fixing unit 9, and a paper discharge unit 10. The laser printer 1 is configured such that, while conveying a sheet along a conveying path L inside the apparatus body 2, the laser printer 1 forms an image on the sheet on the basis of image data transmitted from a not-shown terminal or the like.

The manual paper feeding unit 6 has a manual feed tray 4 installed in one side portion of the apparatus body 2 so that the manual feed tray 4 can be opened and closed, and a manual paper feeding roller 5 rotatably installed inside the apparatus body 2.

The cassette paper feeding unit 7 is installed in the bottom portion of the apparatus body 2. The cassette paper feeding unit 7 includes a paper feeding cassette 11 that contains a plurality of sheets overlapping one above another, a pick roller 12 that takes out, one by one, the sheets held inside the paper feeding cassette 11, and a feed roller 13 and a retard roller 14 that separate the taken-out sheets one by one and feed the sheets to the conveying path L.

The image forming unit 8 is installed above the cassette paper feeding unit 7 inside the apparatus body 2. The image forming unit 8 includes a photosensitive drum 16 as an image carrier, a charger 17, a developing unit 18, a transfer roller 19, a cleaning unit 20, and a laser scanner unit (LSU) 30 as an optical scanner. The photosensitive drum 16 is rotatably installed inside the apparatus body 2. The charger 17, the developing unit 18, the transfer roller 19, and the cleaning unit 20 are arranged around the photosensitive drum 16. The laser scanner unit (LSU) 30 is arranged above the photosensitive drum 16. The developing unit 18 is supplied with toner from the toner container 21. Thus, the image forming unit 8 is configured to form an image on the sheet supplied from the manual paper feeding unit 6 or the cassette paper feeding unit 7.

It is noted that, a pair of register rollers 15 that temporarily keeps the fed sheet on standby and then supplies the sheet to the image forming unit 8 at a predetermined timing is installed in the conveying path L.

The fixing unit 9 is arranged at one side of the image forming unit 8. The fixing unit 9 includes a fixing roller 22 and a pressing roller 23 which are pressed against each other and are rotated together. The fixing unit 9 is configured to fix a toner image, which is transferred to the sheet by the image forming unit 8, to the sheet.

The paper discharge unit 10 is installed above the fixing unit 9. The paper discharge unit 10 includes a paper discharge tray 3, a pair of paper discharge rollers 24 that convey the sheet to the paper discharge tray 3, and a plurality of conveyance guide ribs 25 that guides the sheet to the paper discharge rollers 24. The paper discharge tray 3 is formed in the upper portion of the apparatus body 2 to have a concave shape.

If the laser printer 1 receives image data, then the photosensitive drum 16 of the image forming unit 8 is rotationally driven and the surface of the photosensitive drum 16 is electrically charged by the charger 17.

Then, on the basis of the image data, laser light is emitted from the laser scanner unit 30 toward the photosensitive drum 16. An electrostatic latent image is formed on the surface of the photosensitive drum 16 by the irradiation of the laser light. On the other hand, the developing unit 18 is supplied with toner from the toner container 21. The electrostatic latent image formed on the photosensitive drum 16 is developed by the developing unit 18 and is visualized as a toner image.

Thereafter, the sheet is pressed against the surface of the photosensitive drum 16 by the transfer roller 19. Thus, the toner image of the photosensitive drum 16 is transferred to the sheet. The sheet to which the toner image is transferred is heated and pressed by the fixing roller 22 and the pressing roller 23 in the fixing unit 9. As a result, the toner image is fixed to the sheet.

<Toner Container>

Each of FIG. 2 to FIG. 5 shows a configuration of the toner container 21 in the present embodiment.

Figure 2:
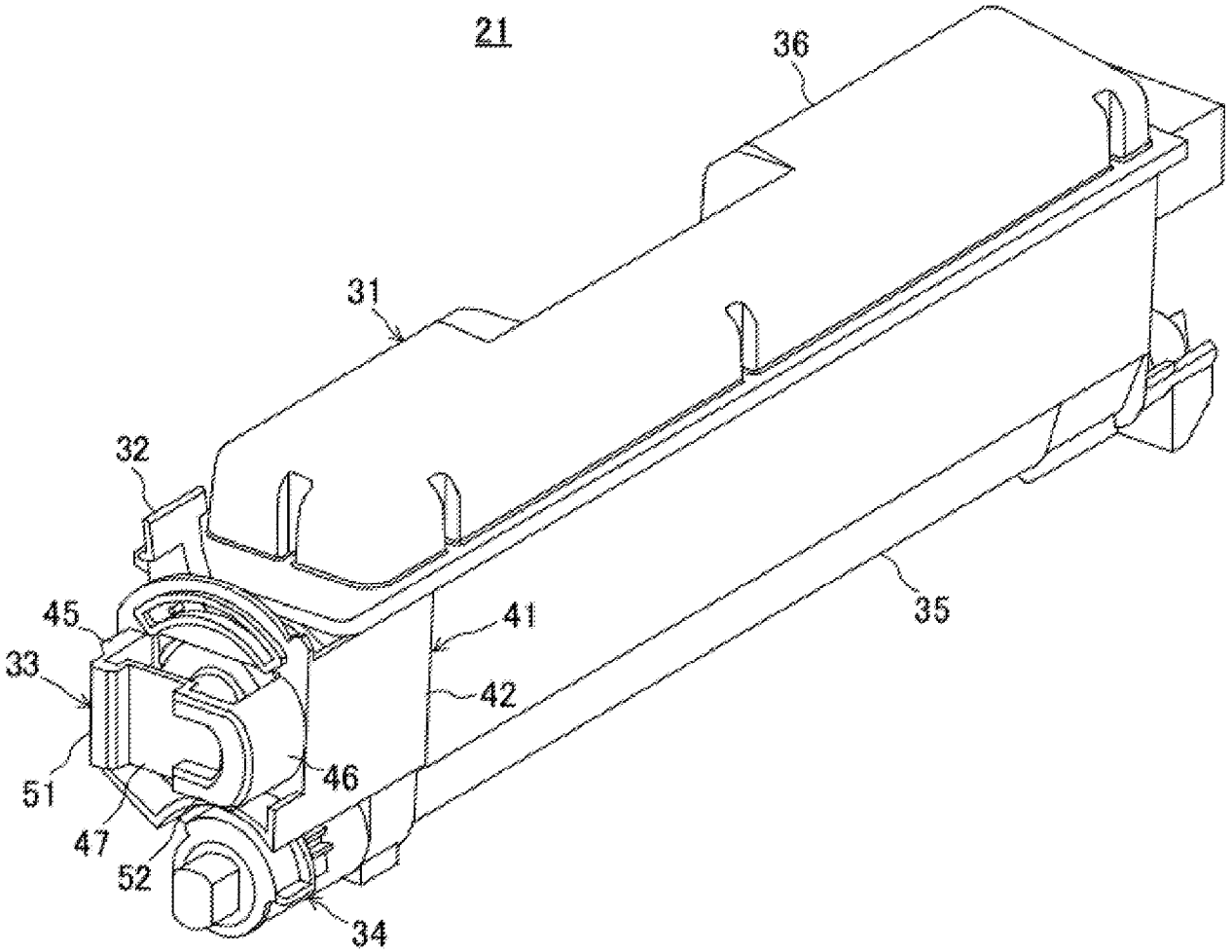
FIG. 2 is a perspective view showing an appearance of a toner container in the present embodiment.

The toner container 21 is arranged, for example, above the image forming unit 8. As shown in FIG. 2, the toner container 21 has a housing 31 that is attached to the apparatus body 2 and contains toner, a lever 32 that opens and closes a toner discharge port 38 of the housing 31, and a bracket portion 33 installed at one side of the housing 31.

The housing 31 is made of a resin material, and formed in an approximately rectangular parallelepiped shape that extends in a predetermined direction. Here, in FIG. 2 to FIG. 5, the longitudinal direction of the housing 31 is referred to as a front-back direction. Further, in FIG. 2 to FIG. 4, the lower left side is called the front side and the upper right side is called the back side.

Figure 5:
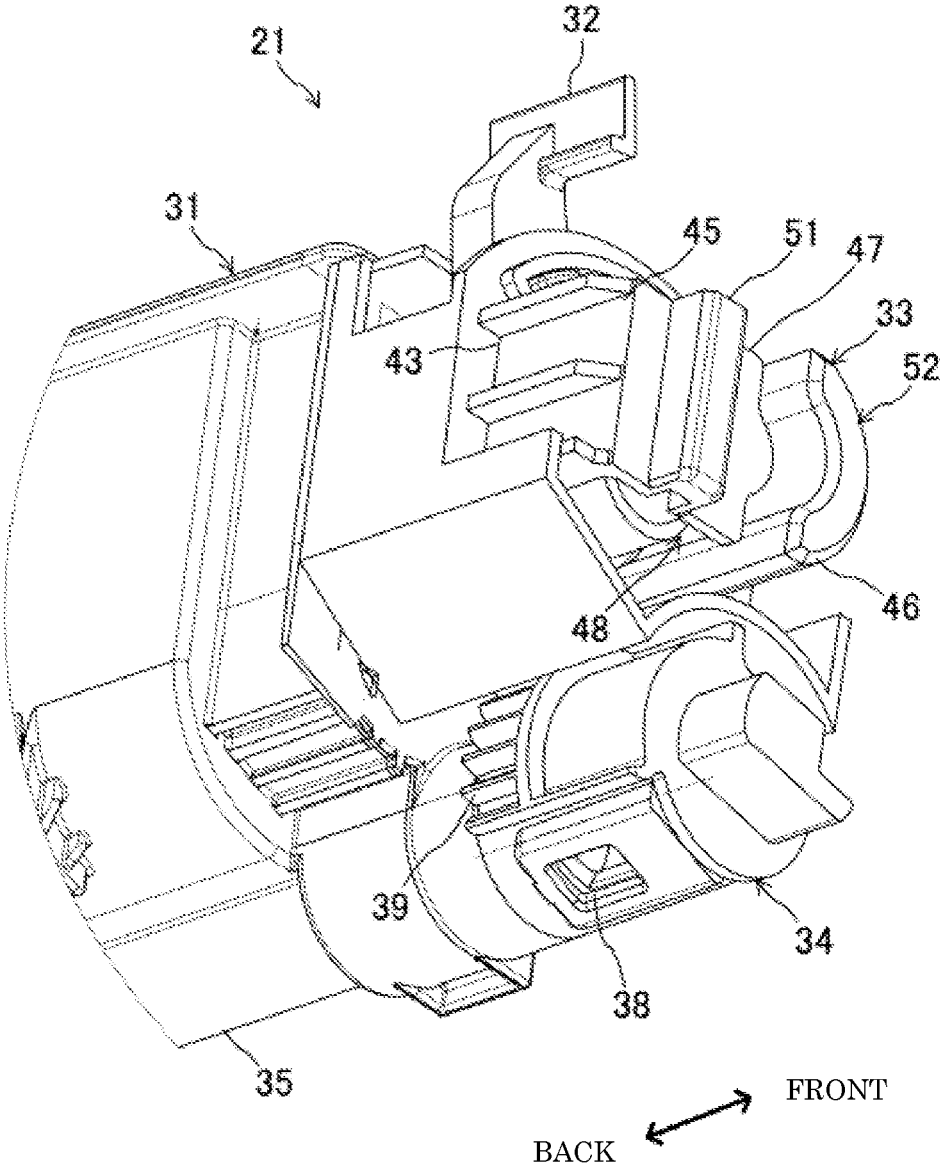
FIG. 5 is a perspective view showing an appearance of the bottom portion of the toner container.

As shown in FIG. 2, the housing 31 has a container body 35 having an open upper portion and a bottom, and a cover portion 36 that closes the open portion of the container body 35. A stirring mechanism (not shown) that stirs toner and a screw portion (not shown) that conveys the toner are installed inside the container body 35. As shown in FIG. 5, the toner discharge port 38 that discharges the toner in the housing 31 and a shutter portion 34 that is driven by the lever 32 and thereby opens and closes the toner discharge port 38 are installed on the front end side of the housing 31.

Further, a support member 41 made of a resin material is attached and fixed to the front end side of the housing 31. The support member 41 is fitted from the outside and fixed onto the front end of the housing 31. Further, the support member 41 is arranged above the shutter portion 34 while overlapping the shutter portion 34.

The support member 41 has a body portion 42 fixed to the front end of the housing 31 and the bracket portion 33 integrally formed at the front end of the body portion 42.

Figure 4:
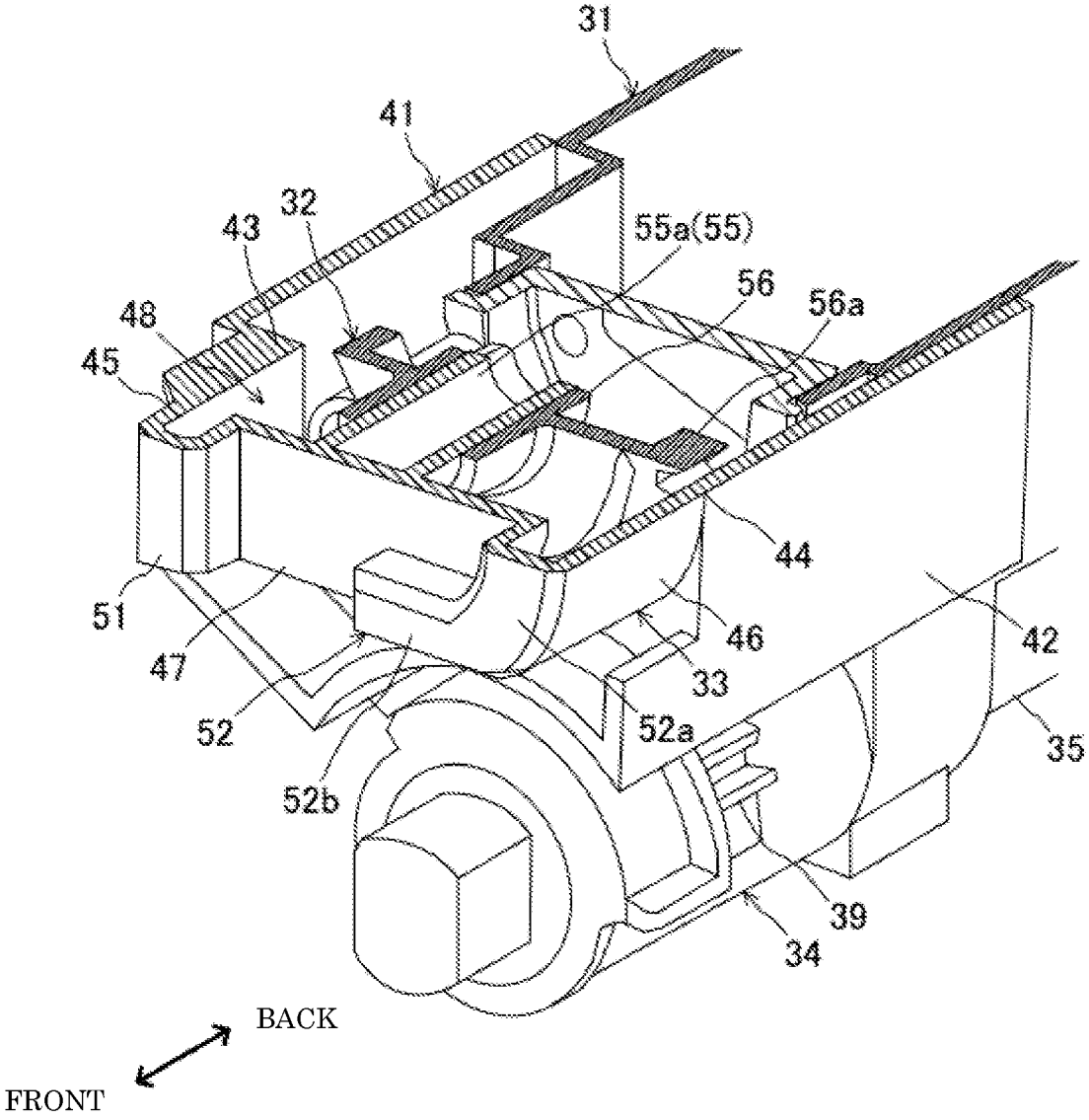
FIG. 4 is a partially-cutaway perspective view showing the protrusion, a functional member, and the bracket portion.

As shown in FIG. 4, the bracket portion 33 is connected to the body portion 42 at a first connection portion 43 and a second connection portion 44 that are separated from each other in the widthwise direction of the housing 31. In other words, the bracket portion 33 is indirectly connected to the housing 31 via the body portion 42 at the first connection portion 43 and the second connection portion 44.

Figure 3:
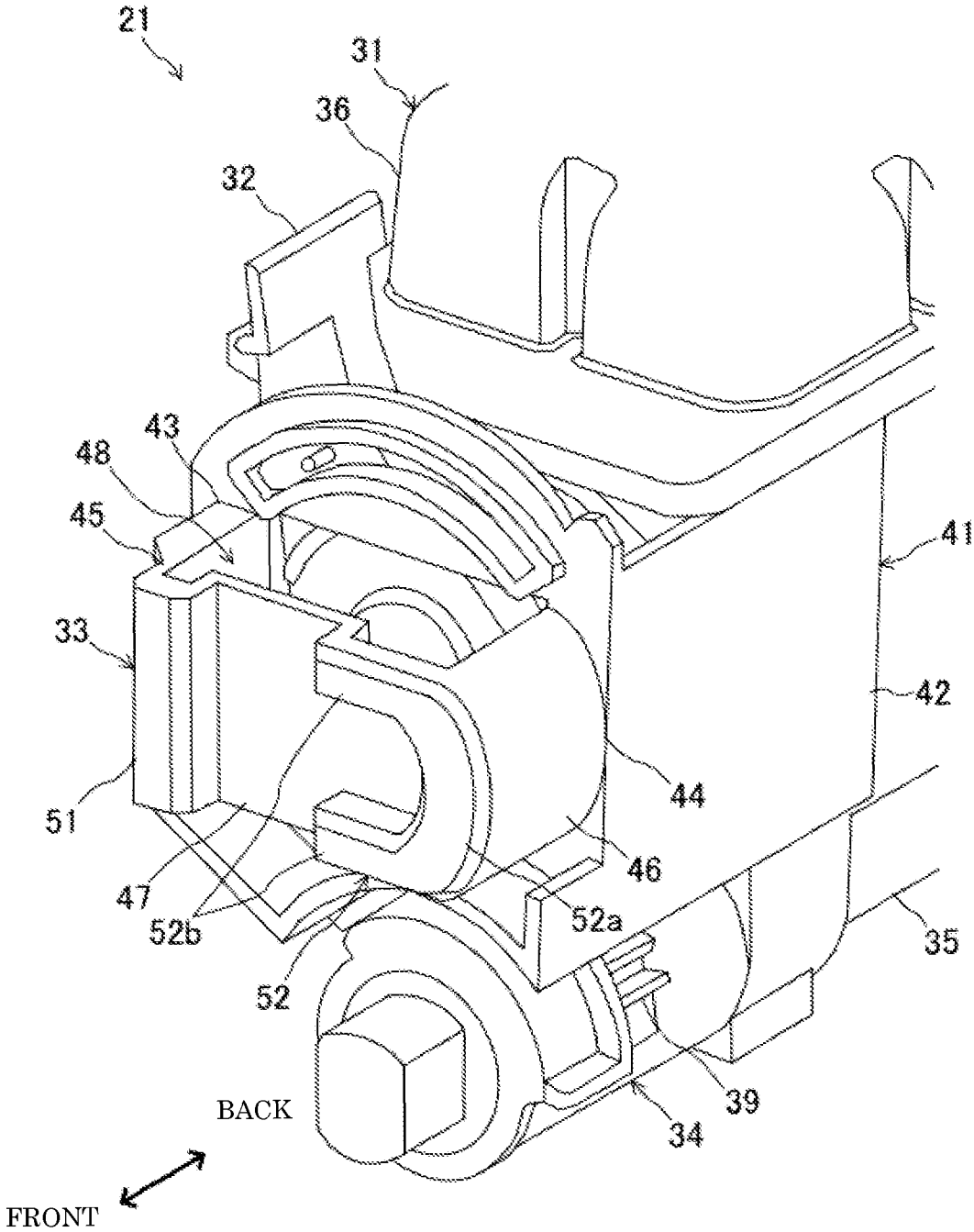
FIG. 3 is a perspective view showing an appearance of a protrusion and a bracket portion on an enlarged scale.

Further, the bracket portion 33 is formed so as to link the first connection portion 43 and the second connection portion 44. That is, as shown in FIG. 3 and FIG. 4, the bracket portion 33 has a first side wall 45 that is connected to the body portion 42 at the first connection portion 43, a second side wall 46 that is arranged to be opposite to the first side wall 45 and connected to the body portion 42 at the second connection portion 44, and a third side wall 47 that links the first side wall 45 and the second side wall 46. Thus, the bracket portion 33 is formed so as to bridge the first connection portion 43 and the second connection portion 44.

An opening 48 enclosed by the front end of the body portion 42, the third side wall 47, the first side wall 45, and the second side wall 46, is formed between the bracket portion 33 and the body portion 42. The opening 48 is opened in the vertical direction in FIG. 3.

As shown in FIG. 3, each of a first protrusion 51 and a second protrusion 52 which protrudes from the third side wall 47 to the front side, is formed in the bracket portion 33. The first protrusion 51 is formed integrally with the first side wall 45 and the third side wall 47 and extends linearly in the vertical direction in FIG. 3. The second protrusion 52 is formed integrally with the second side wall 46 and the third side wall 47, and has a curved portion 52*a* that is curved along with the second side wall 46, and linear portions 52*b* which extend from the both ends of the curved portion 52*a* to the side of the first protrusion 51. Further, the first protrusion 51 and the second protrusion 52 are formed across one end (the upper end in FIG. 3) and the other end (the lower end in FIG. 3) of the bracket portion 33. A hollow that is recessed in the front along the protruded shape of each of the first protrusion 51 and the second protrusion 52, when seen from the back, is formed.

Thus, the first protrusion 51 and the second protrusion 52 are configured to allow for attachment of the housing 31 to the apparatus body 2 in the laser printer 1 of a specific model and not to allow for attachment of the housing 31 to an apparatus body in a laser printer of other models except for the specific model.

Figure 6:
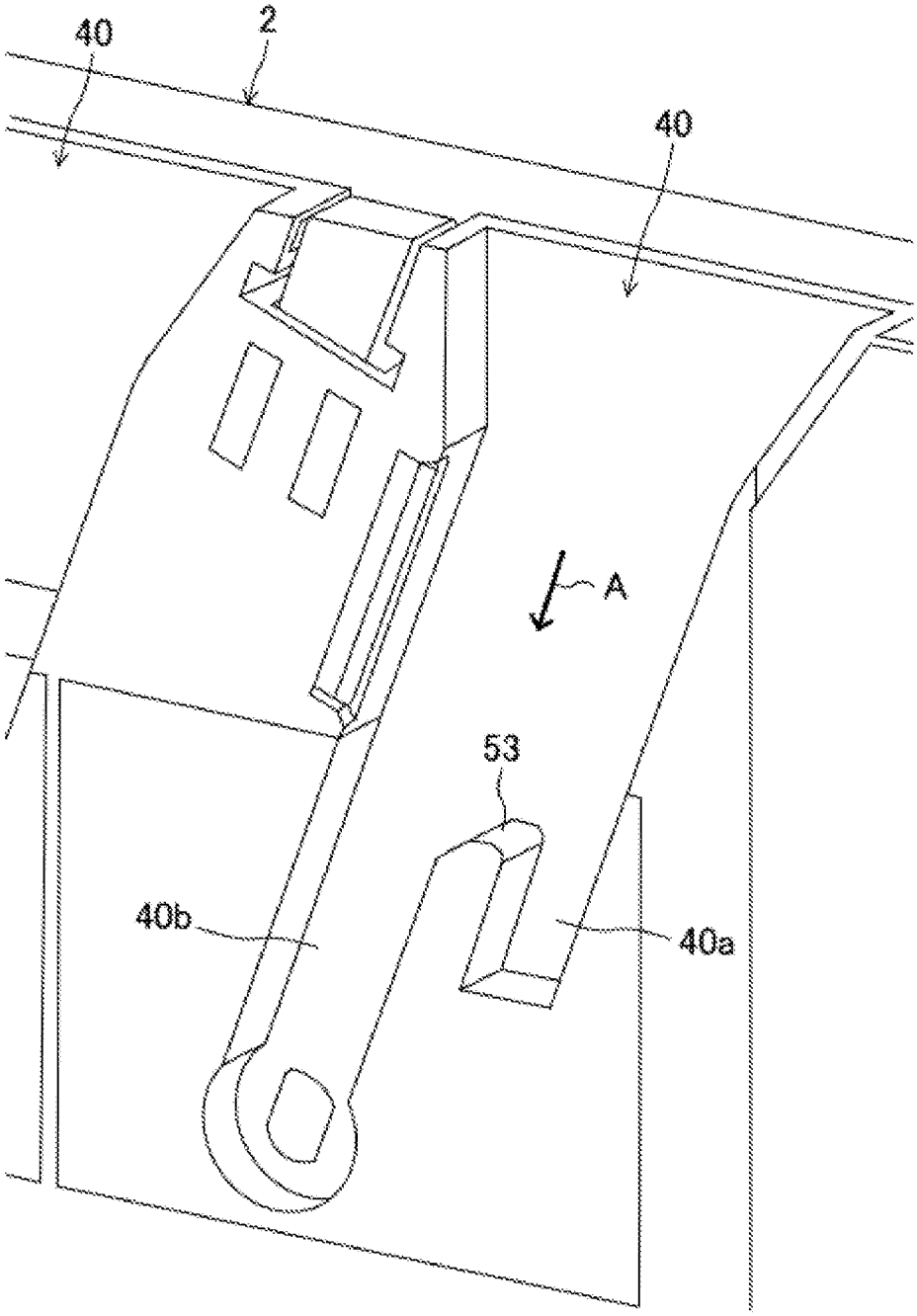
FIG. 6 is a perspective view showing a groove structure to which the toner container is attached.

Here, FIG. 6 shows a groove 40 to which the toner container 21 is attached in the apparatus body 2. Each of FIG. 7 to FIG. 9 shows a positional relation among the groove 40 and a groove 140, the first protrusion 51 and a first protrusion 151, and the second protrusion 52 and a second protrusion 152.

As shown in FIG. 6, a plurality of grooves 40 are formed on the apparatus body 2 and the bracket portion 33 of the toner container 21 is slid and inserted into the grooves 40. The groove 40 has a first groove 40*a* into which the first protrusion 51 is slid and inserted and a second groove 40*b* into which the second protrusion 52 is slid and inserted. A ridge 53 extending along the first groove 40*a* and the second groove 40*b* is formed between the first groove 40*a* and the second groove 40*b*.

The width of the first groove 40*a* in the direction orthogonal to the insertion direction A of the bracket portion 33 is configured to be approximately the same as the width of the first protrusion 51. Further, the width of the second groove 40*b* in the direction orthogonal to the insertion direction A of the bracket portion 33 is configured to be approximately the same as the width of the second protrusion 52. Further, an interval between the first protrusion 51 and the second protrusion 52 is configured to be the same as the width of the ridge 53. Therefore, the first protrusion 51 and the second protrusion 52 allow for attachment of the housing 31 to the apparatus body 2 in the laser printer 1 of the specific model shown in FIG. 7.

Figure 7:
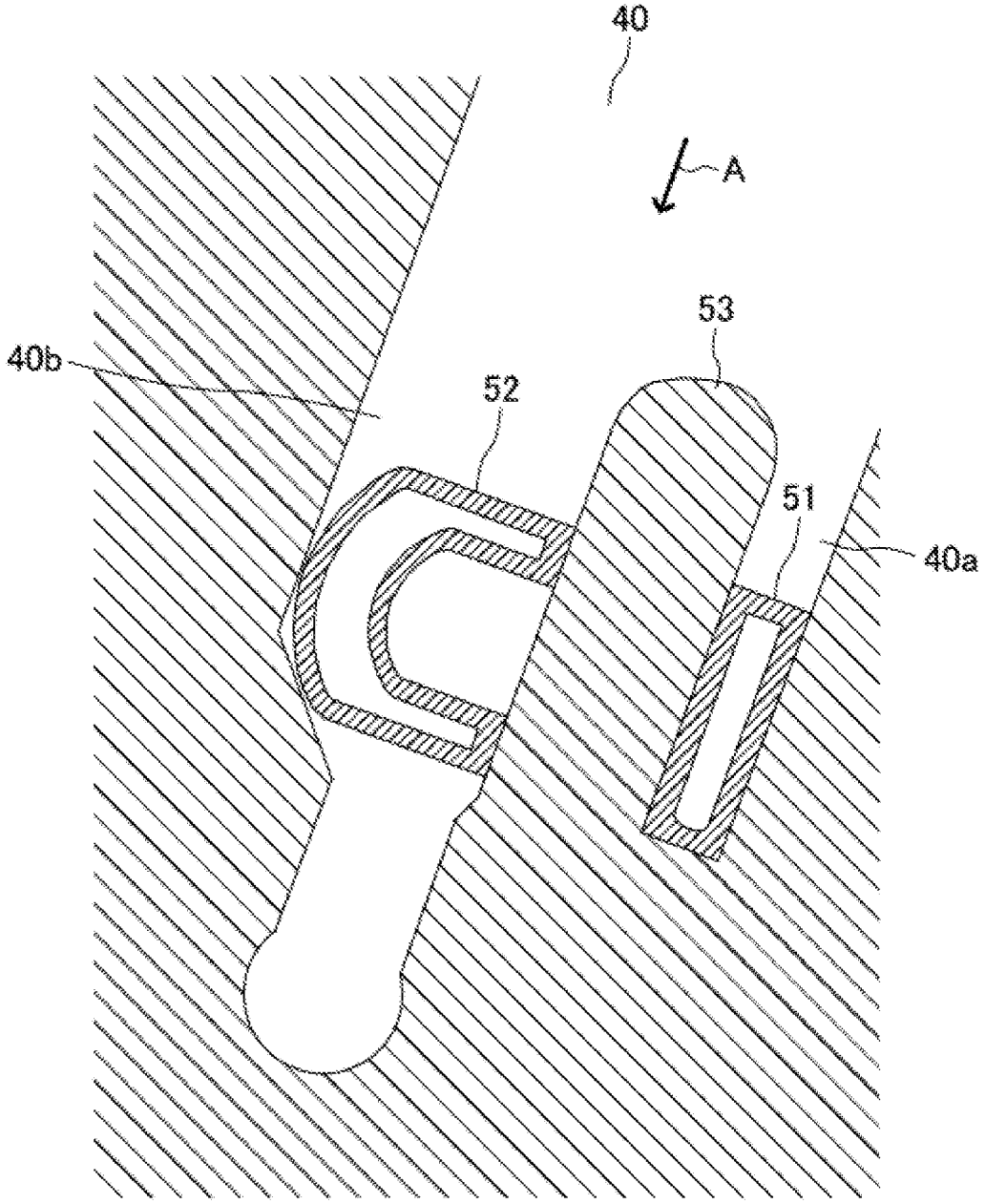
FIG. 7 is a cross-sectional view showing a protrusion and a groove into which the protrusion is inserted in the present embodiment.
Figure 8:
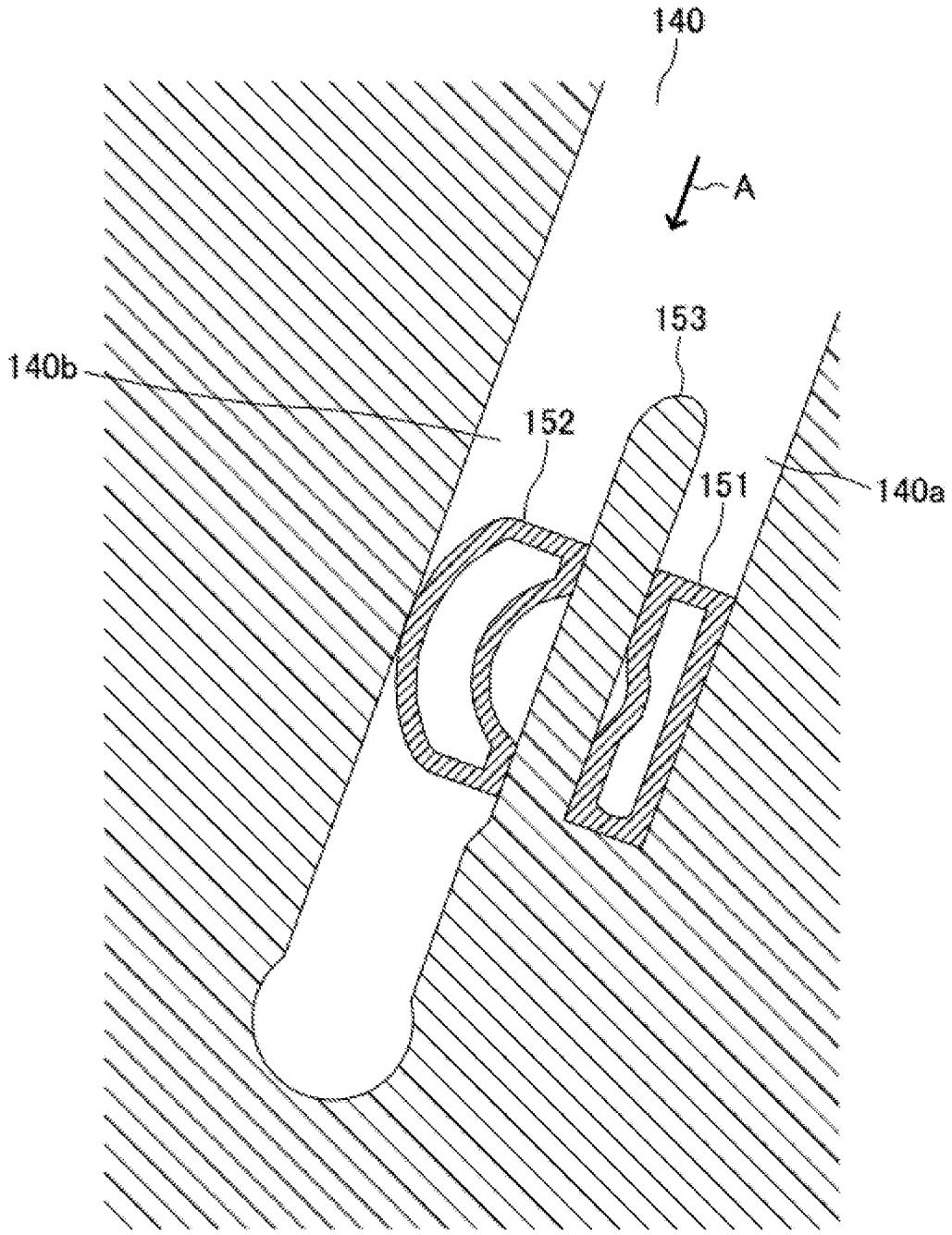
FIG. 8 is a cross-sectional view showing a protrusion and a groove into which the protrusion is inserted in another model.
Figure 9:
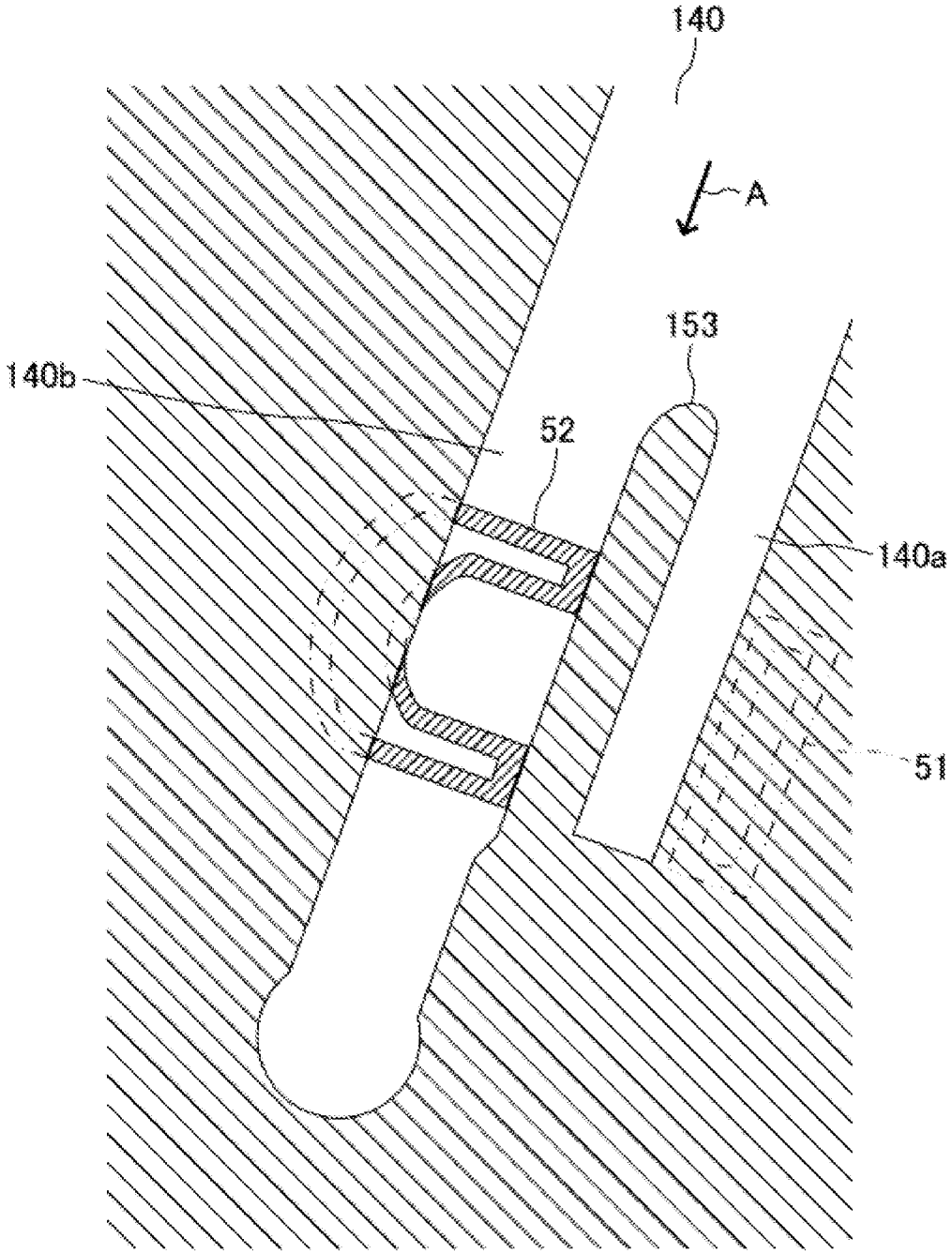
FIG. 9 is a cross-sectional view showing a positional relation between the groove of the other model and the protrusion in the present embodiment.

On the other hand, as shown in FIG. 8, for a toner container adapted for another model, similarly to the case in FIG. 7, the width of each of the first protrusion 151 and the second protrusion 152 is configured to be approximately the same as that of each of a first groove 140*a* and a second groove 140*b* in the apparatus body of the other model, and the interval between the first protrusion 151 and the second protrusion 152 is approximately the same as the width of the ridge 153, and thus, the first protrusion 151 and the second protrusion 152 of the toner container allow for attachment of the housing to the apparatus body of the other model.

Therefore, as shown in FIG. 9, since the groove 140 in the apparatus body of the other model is interfered with the first protrusion 51 and the second protrusion 52 of the toner container 21 adapted for the specific model, the toner container 21 adapted for the specific model is configured to be not attachable to the groove 140 in the apparatus body of the other model.

Further, a functional member 55 that fulfills a predetermined function is installed in the bracket portion 33. As shown in FIG. 4, the functional member 55 in the present embodiment is a shaft portion 55*a* that swingably supports the lever 32. That is, the shaft portion 55*a* is formed integrally with the third side wall 47 of the bracket portion 33, and configured by a cylindrical member that extends from the third side wall 47 to the back side. The base end side of the shaft portion 55*a* is arranged between the first protrusion 51 and the second protrusion 52.

On the other hand, the lever 32 has a hub portion 56 that is inserted into the shaft portion 55*a*. Therefore, the lever 32 is supported by the shaft portion 55*a*. When the lever 32 is operated and the lever 32 swings around the shaft portion 55*a*, the hub portion 56 rotates around the shaft portion 55*a*, and a gear 56*a* formed around the hub portion 56 is engaged with a gear 39 of the shutter portion 34 and rotates. Thereby, the shutter portion 34 is configured to open and close the toner discharge port 38.

Therefore, according to the first embodiment, since the first protrusion 51 and the second protrusion 52 are formed and the shaft portion 55*a* as a functional member is formed in the bracket portion 33 formed so as to link the first connection portion 43 and the second connection portion 44, if the first protrusion 51 and the second protrusion 52 are cut off by a user, then the mechanical strength of the bracket portion 33 is decreased, thus making it difficult to reliably support the shaft portion 55*a* by the bracket portion 33. As a result, the toner container 21 from which the first protrusion 51 and the second protrusion 52 are cut off, can no longer reliably fulfill the function of swingably supporting the lever 32 by the shaft portion 55*a*. Then, it becomes difficult to perform an open and close operation of the housing 31 by the lever 32. In particular, in each of the first protrusion 51 and the second protrusion 52, a hollow that is recessed in the front along the protruded shape of each of the first protrusion 51 and the second protrusion 52, when seen from the back, is formed, and thus, if the first protrusion 51 and the second protrusion 52 are cut off, then the functional member 55, together with the third side wall 47, is separated from the side of the container body 35 and floats in the air. Therefore, it becomes impossible to open and close the toner discharge port 38 of the shutter portion 34 by the lever 32.

That is, according to the present embodiment, even if a user cuts off the first protrusion 51 and the second protrusion 52, the function, by the shaft portion 55*a*, of the toner container 21 is restricted, thus making it possible to prevent diversion of the toner container 21 to other models.

Further, since the first protrusion 51 and the second protrusion 52 are formed across one end and the other end of the bracket portion 33, when the first protrusion 51 and the second protrusion 52 are cut off, the bracket portion 33 is separated. Therefore, since the shaft portion 55*a* installed in the bracket portion 33 is no longer stably supported by the bracket portion 33, the function by the shaft portion 55*a* can no longer be fulfilled more reliably. Accordingly, the diversion of the toner container 21 to other models can be made more difficult.

Furthermore, since the first protrusion 51 and the second protrusion 52 are formed integrally with the bracket portion 33, when the first protrusion 51 and the second protrusion 52 are cut off, a part of the bracket portion 33 is also cut off easily at the same time. Therefore, the function of the shaft portion 55*a* can be made more difficult to be fulfilled.

Furthermore, since the shaft portion 55*a* is formed integrally with the bracket portion 33, when a part of the bracket portion 33 is cut off together with the first protrusion 51 and the second protrusion 52, the shaft portion 55*a*, together with the bracket portion 33, is also cut off easily. Therefore, the function of the shaft portion 55*a* can be made more difficult to be fulfilled.

Further, since the laser printer 1 includes the toner container 21, when the first protrusion 51 and the second protrusion 52 of the toner container 21 are cut off, it becomes difficult to divert the toner container 21 to other models. Therefore, it is possible to avoid a mechanism failure, an image failure, and the like of the laser printer 1 due to use of toner different from toner that should be used originally.

<<Other Embodiments>>

Figure 10:
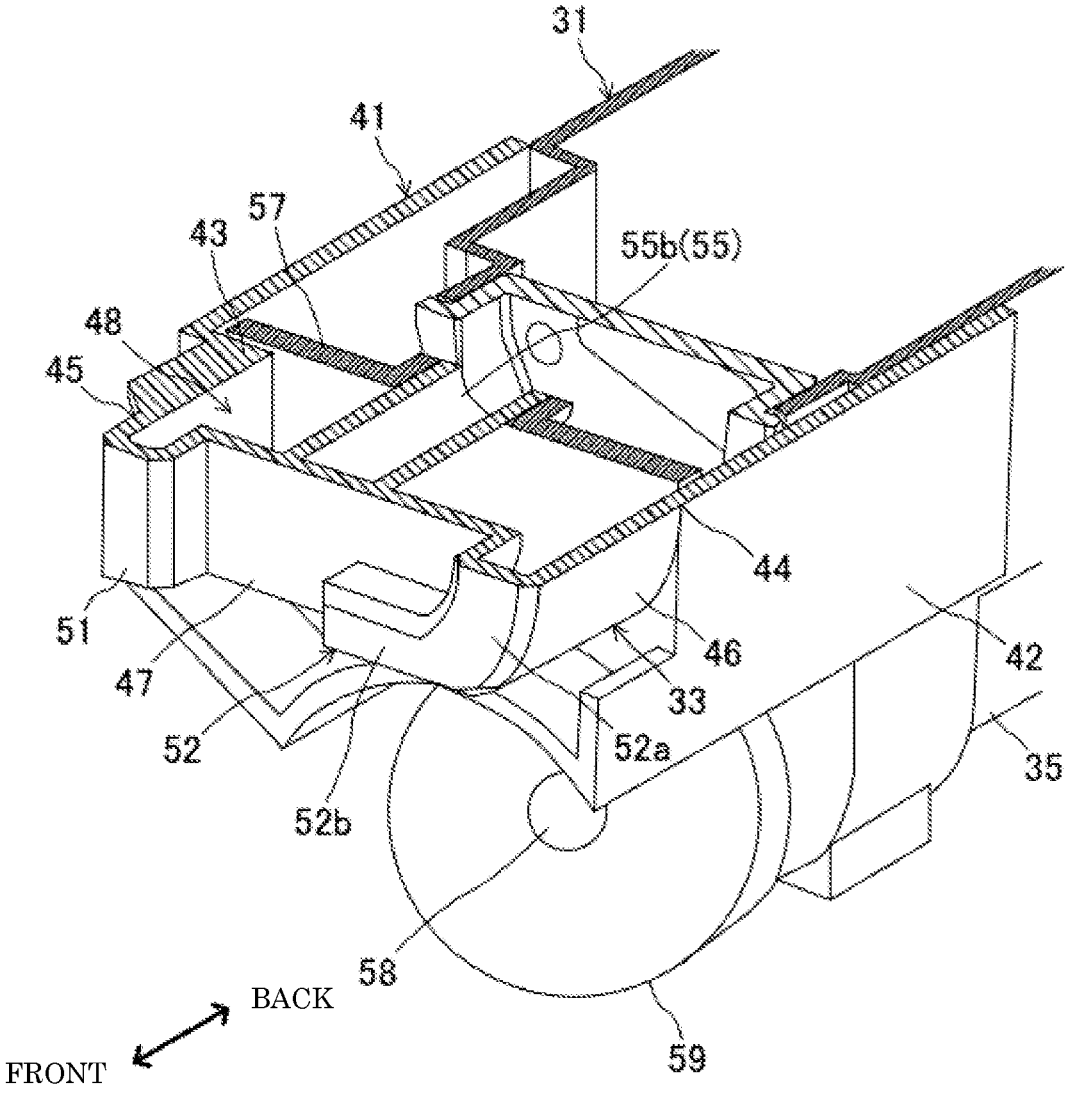
FIG. 10 is a partially-cutaway perspective view showing a protrusion, a functional member, and a bracket portion in another embodiment.
Figure 11:
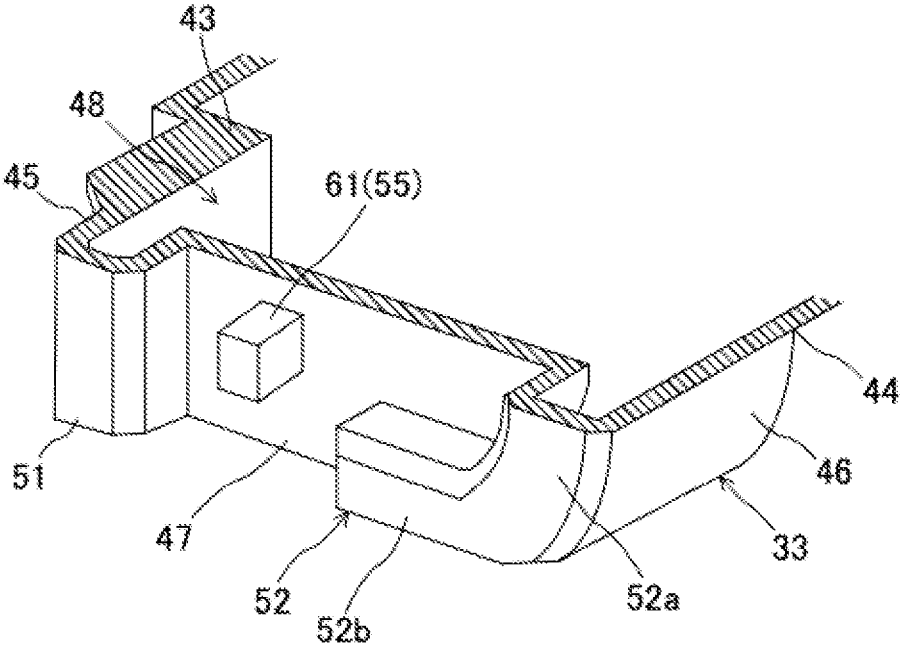
FIG. 11 is a perspective view showing a functional member in still another embodiment.
Figure 12:
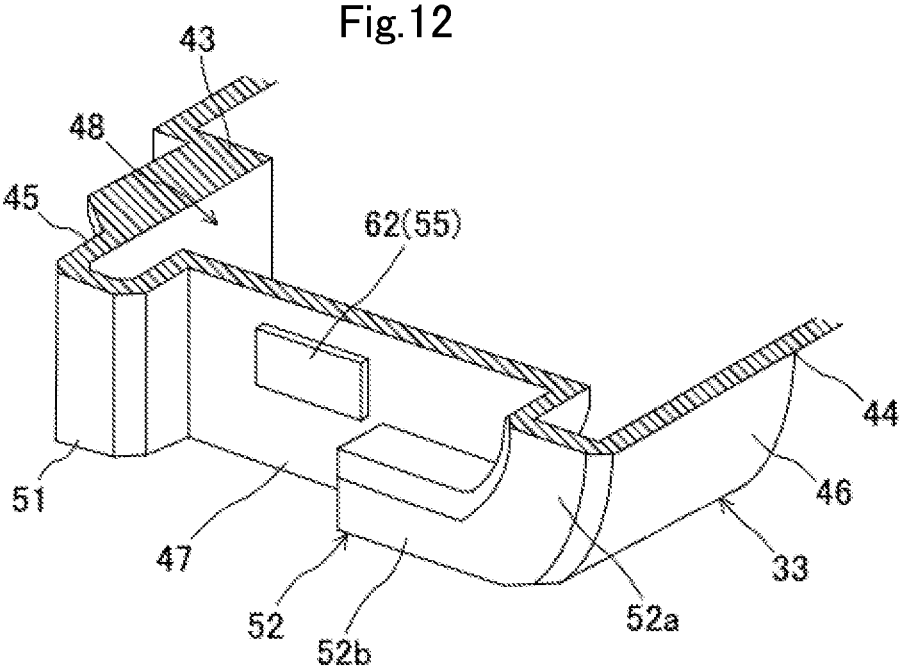
FIG. 12 is a perspective view showing a functional member in yet another embodiment.

Each of FIG. 10 to FIG. 12 shows an example of the functional member 55 in each of other embodiments.

In the first embodiment, a description has been given for an example in which the functional member 55 is the shaft portion 55*a* that swingably supports the lever 32, however, not limited thereto, it may be configured such that the functional member 55 that fulfills another function is installed in the bracket portion 33.

For example, the toner container 21 shown in FIG. 10 has a shaft portion 55*b* that rotatably supports a gear 57 that transmits driving force that is input to the toner container 21, as a functional member 55. It is noted that, in FIG. 10, the tooth profile of the gear 57 is not shown.

Similarly to the first embodiment, the shaft portion 55*b* is formed integrally with the third side wall 47 of the bracket portion 33 on which the first protrusion 51 and the second protrusion 52 are formed. The gear 57 is engaged with a gear 59 that is attached and fixed to a rotating shaft 58 that transmits driving force to the screw portion.

With such a configuration, the toner container 21 from which the first protrusion 51 and the second protrusion 52 are cut off from the bracket portion 33, can no longer reliably fulfill the function of rotatably supporting the gear 57 by the shaft portion 55*b*.

Therefore, even if a user cuts off the first protrusion 51 and the second protrusion 52, the function, by the shaft portion 55*b*, of the toner container 21 is restricted, thus making it possible to prevent diversion of the toner container 21 to other models.

Further, the toner container 21 shown in FIG. 11 has a protrusion 61 formed on the third side wall 47 of the bracket portion 33 so as to protrude to the front side, as a functional member 55. The protrusion 61 is configured such that, when the toner container 21 gets attached to the apparatus body 2, a switch (not shown) installed on the apparatus body 2 is pressed, and thereby whether or not the toner container 21 is attached to the apparatus body 2, is detected.

Accordingly, with this configuration, the toner container 21 from which the first protrusion 51 and the second protrusion 52 are cut off from the bracket portion 33, can no longer reliably fulfill the function of detecting the attachment state of the toner container 21 by the protrusion 61.

Therefore, even if a user cuts off the first protrusion 51 and the second protrusion 52, the function, by the protrusion 61, of the toner container 21 is restricted, thus making it possible to prevent diversion of the toner container 21 to other models.

Further, the toner container 21 shown in FIG. 12 has a circuit board 62 having an electronic processing function as a functional member 55. The circuit board 62 is installed, for example, on the front surface of the third side wall 47 of the bracket portion 33.

Accordingly, with this configuration, the toner container 21 from which the first protrusion 51 and the second protrusion 52 are cut off from the bracket portion 33, can no longer reliably fulfill the electronic processing function by the circuit board 62.

Therefore, even if a user cuts off the first protrusion 51 and the second protrusion 52, the function, by the circuit board 62, of the toner container 21 is restricted, thus making it possible to prevent diversion of the toner container 21 to other models.

It is noted that, in the embodiment, a description has been given for an example in which the bracket portion 33 is indirectly connected to the housing 31 via the body portion 42 at the first connection portion 43 and the second connection portion 44, however, not limited thereto, it may be configured such that the bracket portion 33 is directly connected to the housing 31 at the first connection portion 43 and the second connection portion 44.

Further, in the present embodiment, a description has been given for the laser printer 1 as one example of the image forming apparatus, however, not limited thereto, the image forming apparatus may also be another image forming apparatus such as a copier, a scanner, or a multifunction peripheral.

As described above, the technology of the present disclosure is useful for a toner case and an image forming apparatus including the same.

The invention claimed is:

1. A toner case that is attached to an apparatus body of an image forming apparatus, the toner case comprising:

a housing that contains toner;

a toner discharge port that discharges the toner in the housing;

a shutter portion that opens and closes the toner discharge port;

a lever that drives the shutter portion;

a shaft portion that swingably supports the lever;

a bracket portion with which the shaft portion is integrally formed and is directly or indirectly connected to the housing;

a first protrusion; and a second protrusion, wherein the bracket portion has a first side wall with one end side directly or indirectly connected to an outer side surface of the housing, a second side wall with one end side directly or indirectly connected to the outer side surface of the housing, and arranged to be opposite to the first side wall, and a third side wall formed so as to link another end side of the first side wall and another end side of the second side wall, the shaft portion is integrally formed with the third side wall of the bracket portion, the first protrusion is integrally formed with the first side wall and the third side wall of the bracket portion, and the second protrusion is integrally formed with the second side wall and the third side wall of the bracket portion, and at least one of the first and second protrusions allowing for attachment of the housing to the apparatus body of a specific model, and not allowing for attachment of the housing to apparatus bodies of other models except for the specific model.

2. The toner case according to claim 1, wherein each of the first protrusion and the second protrusion is formed across one end and another end of the third side wall of the bracket portion.

3. An image forming apparatus that includes the toner case according to claim 1.

* * * * *